United States Patent [19]

Cobb

[11] 4,278,295

[45] Jul. 14, 1981

[54] IMPACTING ROCK BREAKER

[75] Inventor: Delwin E. Cobb, Peoria, Ill.

[73] Assignee: Caterpillar Tractor Co., Peoria, Ill.

[21] Appl. No.: 145,065

[22] PCT Filed: Dec. 13, 1979

[86] PCT No: PCT/US79/01087

§ 371 Date: Dec. 13, 1979

§ 102 (e) Date: Dec. 13, 1979

[51] Int. Cl.[3] ..... E21C 27/28; A01B 35/00

[52] U.S. Cl. ..... 299/69; 173/94; 299/37

[58] Field of Search ..... 299/14, 37, 62, 67, 299/69, 70; 173/94, 98, 99, 123

[56] References Cited

U.S. PATENT DOCUMENTS

| | | | |
|---|---|---|---|
| 1,707,887 | 4/1929 | Wagner | 173/98 |
| 2,584,330 | 2/1952 | Craig | 173/99 |
| 3,770,322 | 11/1973 | Cobb et al. | 299/37 |
| 3,868,145 | 2/1975 | Cobb et al. | 173/98 X |
| 3,922,017 | 11/1975 | Cobb | 173/94 X |

*Primary Examiner*—Ernest R. Purser

*Attorney, Agent, or Firm*—Wegner, Stellman, McCord, Wiles & Wood

[57] ABSTRACT

An impactor (10) having a fracturing portion (11) including a crank (12) and a force transferring structure (13). The force transferring structure (13) is hammered as a result of rotation of the crank (12) by a hammer (14) rotatably mounted to the crank for concurrent revolution about the crank axis (16) and rotation about a hammer axis (24). The hammer is rotated in synchronization with the crank to move a contacting portion (20) of the hammer reciprocatively toward and from the force transfer structure (13) with contact between the hammer and force transfer structure being free of rolling movement therebetween.

8 Claims, 6 Drawing Figures

IMPACTING ROCK BREAKER

DESCRIPTION

1. Technical Field

This invention relates to impacting rock breakers and in particular to means for providing an impacting force to the fracturing means thereof.

2. Background Art

In U.S. Pat. No. 3,868,145 of Delwin E. Cobb et al, which patent is owned by the assignee hereof, a rotary eccentric shaft drive is provided for mechanically driving the impact rock fracturing mechanism. An impact member in the form of a ring is rotatably mounted on the eccentric shaft so as to be driven in an orbital path and thereby intermittently engage the fracturing mechanism shank. A reaction ring constrains the ring impact member to rotate with respect to the eccentric shaft.

Another form of impacting apparatus is illustrated in U.S. Pat. No. 3,770,322 of Delwin E. Cobb et al, which patent is also owned by the assignee hereof. As shown therein, the impacting energy is stored in a flywheel and cyclically delivered by the transmission means to the work tool. The transmission means includes an impact device and a substantially rigid element establishing a positive connection of the eccentric shaft mounting the flywheel to the impact device.

In U.S. Pat. No. 3,922,017 of Delwin E. Cobb, which patent is also owned by the assignee hereof, an impacting fracturing apparatus is operated by a drive shaft rotatably mounted in a housing and having an eccentric journal mounted thereon for rotation therewith. A rigid link is journaled at one end to the eccentric journal and pivotally connected to the impact member of the apparatus which is supported by the housing member for impact engagement with an elongated fracturing shank pivotally mounted at one end to the housing member.

DISCLOSURE OF INVENTION

The present invention comprehends an improved impactor for use as a rock breaker or the like wherein the hammer is rotatably mounted to a crank for concurrent revolution about the axis of the crank and rotation about a hammer axis extending parallel to the crank axis and revolved about the crank axis. The hammer defines a rounded contacting portion engaging the fracturing member. Means are provided for rotating the hammer in synchronization with the crank rotation to move the contacting portion reciprocatively toward and from the force transfer member so as to cause the contacting portion of the hammer to impact against the force transfer member with a rotational engagement free of rolling movement therebetween.

In the illustrated embodiment, the crank is rotatably mounted in a housing and the means for rotating the hammer in synchronization with the crank rotation includes meshing gears on the housing and the hammer.

The contacting portion of the hammer, in the illustrated embodiment, defines a right circularly cylindrical surface portion engaging a complementary portion of the force transfer means.

In the illustrated embodiment, the hammer surface portion defines a center point which is reciprocated rectilinearly as a result of the concurrent rotation and revolution of the hammer about the crank and hammer axes.

In the illustrated embodiment, the crank defines a recess for receiving the contacting portion of the hammer at the portion of its rotation most remote from the force transfer means.

Thus, the impactor structure of the present invention is extremely simple and economical of construction while yet providing an improved impacting functioning and affording a long, troublefree life of the apparatus. The impactor structure effectively minimizes the contact stresses on the impacting surfaces of the apparatus and avoids large power losses as have occurred in the impactor structure of the prior art. Further, the novel rotational impacting action effectively lowers the noise level of the apparatus and effectively minimizes undesirable shaking forces.

BEST MODE FOR CARRYING OUT THE INVENTION

Figure 1:
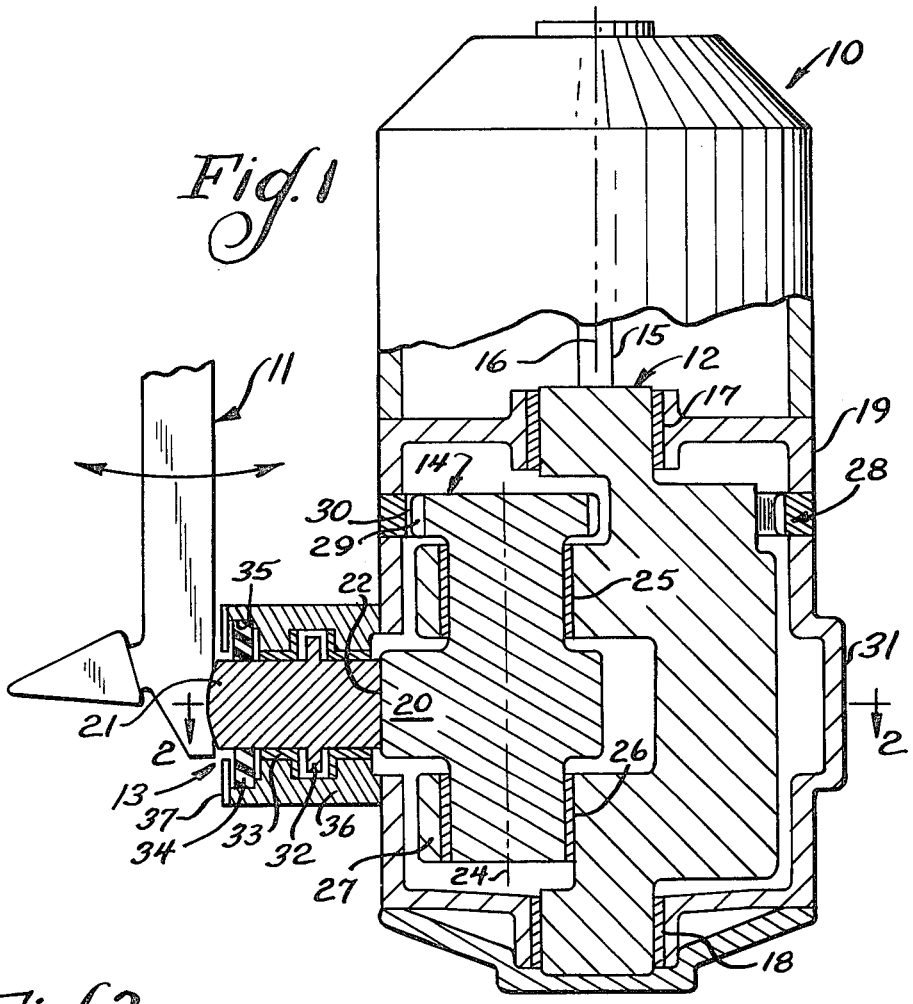
FIG. 1 is a fragmentary side elevation with portions broken away illustrating the construction of the impactor of the invention.

In the exemplary embodiment of the invention as disclosed in the drawing, an impactor generally designated 10 is shown to include a fracturing means generally designated 11, a crank generally designated 12, a force transfer means generally designated 13, and a hammer generally designated 14.

As shown in FIG. 1, the crank is rotatably mounted on a crankshaft 15 for rotation about a crank axis 16 by suitable rotatable drive means (not shown). The crank is journaled in a pair of bearings 17 and 18 carried by a housing 19.

Figure 2:
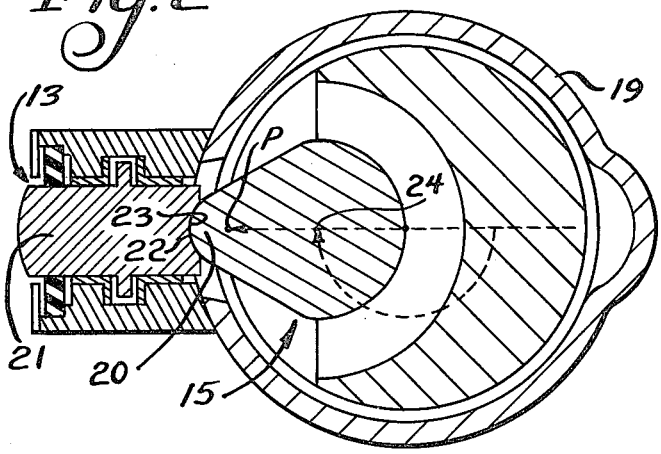
FIG. 2 is a fragmentary horizontal section taken substantially along the line 2—2 of FIG. 1.

Hammer 14 defines a lobe 20 forming the contacting portion thereof adapted to impact against a link 21 of the force transfer means 13. As seen in FIG. 2, the contacting portion 20 defines a right circularly cylindrical surface 22 which engages a complementary recess portion 23 of the link in the impacting engagement of the hammer with the force transfer means.

As shown in FIG. 1, hammer 14 is journaled for rotation about a hammer axis 24 by a pair of bearings 25 and 26 at opposite sides of the contacting lobe 20. The bearings are retained on crank 12 by means of suitable bearing caps 27.

Thus, hammer 14 is mounted to crank 12 for revolution therewith about the crank axis 16. Concurrently with such revolution, the hammer is caused to rotate about hammer axis 24 by suitable gear means 28, including gear teeth 29 provided at one end of the hammer, and meshing gear teeth 30 provided on housing 19.

In the illustrated embodiment, the gear ratio is two-to-one so that a point P defining the center of the cylindrical contacting surface 22 reciprocates rectilinearly toward and from the link 21 as a result of rotation of the crank 12 about its axis 16. The resulting movement of the hammer 14 is illustrated in the sequential showings of FIGS. 2–6. As a result of this concurrent revolution and rotation of the hammer, the contact of surface 22 with link 21 in recess 23, providing the impact force to the link for effecting the rock breaking operation of the fracturing arm 11, is a rotational engagement free of rolling movement between the two members so that an extremely close fit is obtained therebetween for improved force transfer.

Figure 3:
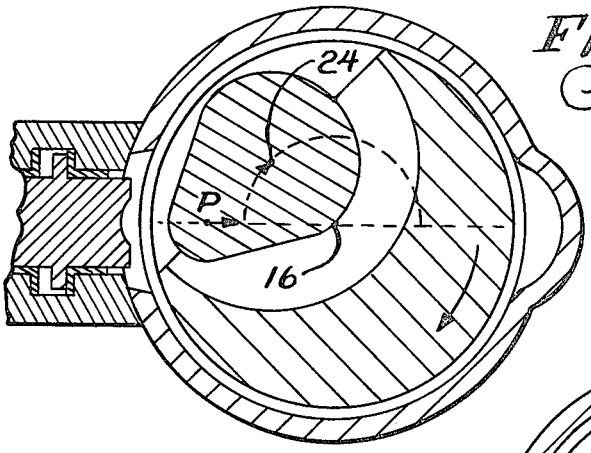
FIG. 3 is a fragmentary horizontal section generally similar to that of FIG. 2 but illustrating the arrangement of the impactor structure shortly subsequent to the transfer of impacting force to the force transfer means.

Referring more specifically to FIGS. 3–6, as the crank rotates in a clockwise direction from the position of FIG. 2, axis 24 of the crank is caused to define a circle around the crank axis 16 while the point P is caused to move rectilinearly radially to and through the axis 16. Thus, as seen in FIG. 3, point P is displaced radially toward axis 16 from its position in FIG. 2 as the axis 24 of the hammer moves upwardly and to the right from its original position.

Figure 4:
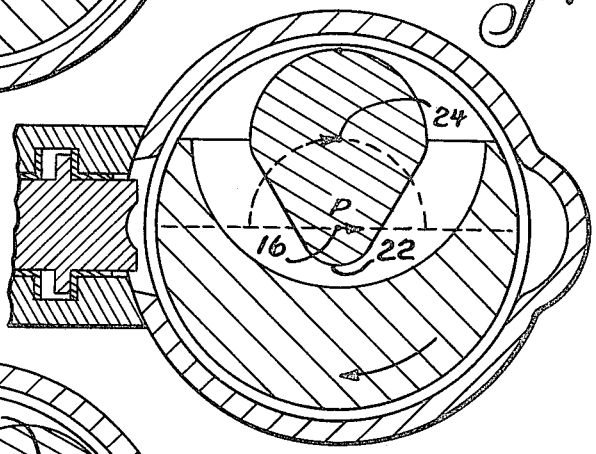
FIG. 4 is a fragmentary horizontal section showing the arrangement of the impactor at a slightly later time in the operation thereof.

As seen in FIG. 4, when the axis 24 of the hammer is vertically above crank axis 16, point P coincides with axis 16 and the contacting surface 22 of the hammer is lowermost.

Figure 5:
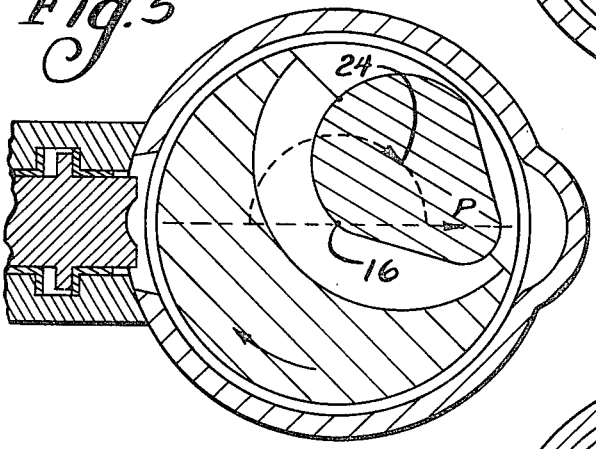
FIG. 5 is a fragmentary horizontal section illustrating the arrangement of the impactor upon still further rotation thereof.

Referring to FIG. 5, as continued clockwise rotation of the crank occurs, hammer axis 24 moves downwardly and toward the right while point P moves further radially away from axis 16.

Figure 6:
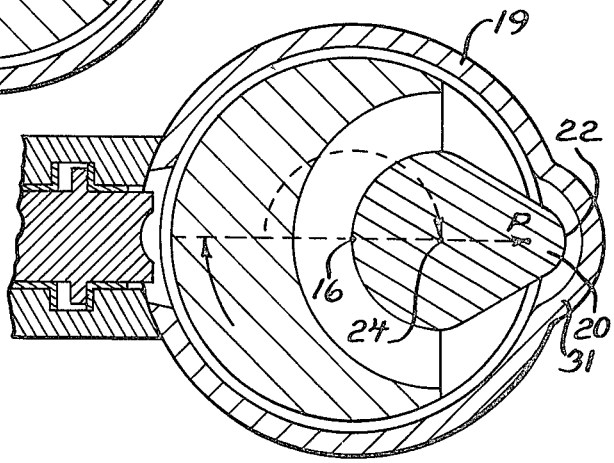
FIG. 6 is a fragmentary horizontal section illustrating the arrangement of the impactor at the time the hammer is at its position most remote from the force transfer means.

Referring to FIG. 6, when the rotation of crank 12 is 180° from the position thereof in FIG. 2, the hammer extends directly reversely to its extent in the position of FIG. 2, with the contacting surface 22 extending directly radially away from the crank axis 16 and with the point P at its maximum righthand position. At this time, the hammer axis 24 lies on the line of movement of the point P and, thus, directly radially oppositely to its position at the time of impact, as shown in FIG. 2.

As further shown in FIG. 6, housing 19 is provided with a projecting portion 31 which receives the projecting portion 22 of the hammer in this disposition.

As will be obvious to those skilled in the art, continued clockwise rotation of crank 12 causes a reversely similar revolution and rotation of the hammer so as to return the hammer to the impacting position of FIG. 2, at which position the contacting surface 22 impacts against the link 21 to provide a further momentary impacting force to be transferred through the link to the fracturing arm 11. This transfer of impacting forces is repeated each time the crank is rotated 360° whereby the impacting rate is a function solely of the rate of rotation of the crank 12.

As illustrated in FIG. 1, link 21 may be provided with a flange portion 32 which limits the reciprocal movement thereof in the link bearing 33 in which the link is slidably carried. As further shown in FIG. 1, a seal 34 may be provided in a suitable recess 35 in the outer end of a link support 36 mounted to the housing 19 for supporting link 21 thereon. As further shown, the retaining ring 37 may be provided for removably retaining seal 34 in recess 35.

INDUSTRIAL APPLICABILITY

Impactor 10 provides an improved impacting force transfer by causing the hammer to engage the force transfer means with a rotational movement free of rolling action therebetween, whereby an improved oil cushion may be formed between the contacting surface 22 and link 21 in recess 23 thereof lowering the contact stresses on the impact surfaces and substantially reducing the noise level in the operation of the impactor.

Impactor 10 further provides a simple low cost construction which may utilize conventional bearings, such as crank bearings 17 and 18, and hammer bearings 25 and 26. The bearings may be of relatively small size for further simplified and economical construction. As discussed above, the bearings are disposed at opposite sides of the contacting portion 20 of the hammer so as to be displaced from the line of impact for reduced bearing losses and extended useful life thereof.

As the link 21 has a relatively small movement, the seal 34 provides a long troublefree life while yet permitting the force transfer means to effectively transfer the high impact forces necessary to operate the fracturing means 11.

As a result of the improved impactor structure, a compact design may be realized further effectively minimizing the cost of construction.

As further illustrated, the housing, or case, 19 is of simple economical construction while yet providing suitable bearing and gear mounting portions of the impactor.

As indicated above, the impactor is advantageously adapted for use as a rock breaker such as for use in mining, demolition, excavation, etc., operations.

Other aspects, objects and advantages of this invention can be obtained from a study of the drawings, the disclosure and the appended claims. The foregoing disclosure of specific embodiments is illustrative of the broad inventive concepts comprehended by the invention.

I claim:

1. In an impactor (10) having fracturing means (11), a crank (12) driven rotatively about a crank axis (16), and a force transfer means (13) for reciprocatively impacting said fracturing means, improved means for hammering said force transfer means as an incident of rotation of said crank comprising:

a hammer (14) rotatively mounted to said crank (12) for concurrent revolution about said crank axis and rotation about a hammer axis (24) parallel to said crank axis, said hammer defining a rounded contacting portion (20); and means (28) for rotating said hammer in synchronization with the crank rotation to move said contacting portion (20) reciprocatively toward and from said force transfer means (13) and cause said contacting portion (20) of the hammer (14) to impact against said force transfer means (13) with a rotational engagement free of rolling movement therebetween, said contacting portion (20) of the hammer (14) defining a right circularly cylindrical surface portion (22) engaging the force transfer means (13), said hammer surface portion (22) defining a center point (P) reciprocated rectilinearly diametrically of said crank axis (16) and in linear alignment with the rectilinear movement of said force transfer means (13) as a result of the concurrent rotation and revolution of said hammer (14) about said axes (16,24).

2. The impactor of claim 1 wherein said force transfer means (13) defines a complementary right circularly cylindrical surface portion (23) facially engaged by said hammer surface portion (22) upon impact therebetween.

3. The impactor of claim 1 wherein said means for rotating the hammer comprises gear means (28).

4. In an impactor (10) having fracturing means (11), a crank (12) driven rotatively about a crank axis (16) within a housing (19), and force transfer means (13) for reciprocatively impacting said facturing means, improved means for hammering said force transfer means as an incident of rotation of said crank comprising:

a hammer (14) rotatively mounted to said crank (12) for concurrent revolution about said crank axis and rotation about a hammer axis (24) parallel to said crank axis, said hammer defining a rounded contacting portion (20); and meshing gear means (30,29) on said housing (19) and hammer (14) for rotating said hammer in synchronization with the crank rotation to move said contacting portion (20) reciprocatively toward and from said force transfer means (13) and cause said contacting portion (20) of the hammer (14) to impact against said force transfer means (13) with a rotational engagement free of rolling movement therebetween, said contacting portion (20) of the hammer (14) defining a right circularly cylindrical surface portion (22) engaging the force transfer means (13), said hammer surface portion (22) defining a center point (P) reciprocated rectilinearly diametrically of said crank axis (16) and in linear alignment with the rectilinear movement of said force transfer means (13) as a result of the concurrent rotation and revolution of said hammer (14) about said axes (16,24).

5. The impactor of claim 4 wherein said gear means (29) is disposed at one end of the hammer (14).

6. The impactor of claim 4 wherein a pair of bearings (25,26) are provided for journaling the hammer (14) on the crank (12), said bearings being disposed one each at opposite sides of the contacting portion (20) of the hammer.

7. The impactor of claim 4 wherein said housing (19) defines a recessed portion (31) for receiving said contacting portion (20) of the hammer at the portion of its rotation most remote from said force transfer means (13).

8. The impactor of claim 4 wherein said crank (12) is journaled in said housing (19).

* * * * *